US005366329A

United States Patent [19]

Burgess

[11] Patent Number: 5,366,329

[45] Date of Patent: Nov. 22, 1994

[54] DRYWALL HOOK

[76] Inventor: James R. Burgess, 49 Tanglewood Estates, 52411 Range Road 214, Ardrossan, Alberta, Canada, T0B 0E0

[21] Appl. No.: 971,082

[22] Filed: Nov. 4, 1992

[51] Int. Cl.[5] ..... F16B 33/00

[52] U.S. Cl. ..... 411/368; 411/401; 411/533

[58] Field of Search ..... 411/401, 400, 396, 397, 411/398, 533, 368, 371, 383, 385; 292/44, 194; 403/323, 49; 248/507

[56] References Cited

U.S. PATENT DOCUMENTS

| | | | |
|---|---|---|---|
| 696,582 | 4/1902 | Myers | 411/397 X |
| 1,491,394 | 4/1924 | Griffith et al. | 411/368 |
| 1,765,614 | 6/1930 | Roberts et al. | 411/400 X |
| 2,266,852 | 12/1941 | Cunningham | 411/169 X |
| 2,417,970 | 3/1947 | Comber | 292/163 X |
| 2,569,941 | 10/1951 | Mastrangelo et al. | 292/194 X |
| 3,309,119 | 3/1967 | Phillips | 411/400 |
| 3,387,814 | 6/1968 | Fischer | 248/507 |
| 3,897,113 | 7/1975 | Walther et al. | 411/368 X |
| 4,038,801 | 8/1977 | Busch | 411/396 X |

FOREIGN PATENT DOCUMENTS

| | | | |
|---|---|---|---|
| 3508534 | 9/1986 | Germany | 411/396 |

*Primary Examiner*—Rodney M. Lindsey
*Attorney, Agent, or Firm*—Terry M. Gernstein

[57] ABSTRACT

There is provided a hook which is functional to temporarily support drywall board prior to its permanent installation. The hook includes a stepped body member having a threaded fastener extending through the central portion thereof.

4 Claims, 4 Drawing Sheets

DRYWALL HOOK

FIELD OF THE INVENTION

The present invention relates to a hook functional to temporarily support drywall board whilst it is being permanently secured to ceiling joists.

BACKGROUND OF THE INVENTION

During the permanent installation of, in particular, drywall boards to form a ceiling, the current practice is simply a manual one. Typically two men would be required to hold these large, cumbersome and heavy panels in aligned abutment to the joist, whilst it is being attached thereto utilizing drywall screws. Usually, this technique further involves one of the installers supporting the drywall board on his head, thereby freeing his hands so as to enable him to operate a screw gun so as to tighten the permanent drywall screws. This method, disadvantageously, is slow, tiresome and labour intensive.

A commercial floor-mounted hoist which is functional to jack the drywall board upwardly is the only apparatus known to applicant currently available to assist as a temporary support. Deleteriously, however, this device has two major drawbacks. First, it is very expensive and secondly it cannot be used on more difficult to access areas, such as in stairwells, or for cathedral ceilings or non-uniform ceiling arrangements.

Exemplary prior art patents which disclose temporary restraining clamps for wall boards include Canadian Patent 1,192,722 and U.S. Pat. No. 5,002,446.

The '722 patent teaches a clamp having an L-shaped body, one leg of which is adapted for contact with the panel, and another leg through which passes a screw, extending a distance therebeyond. Unfortunately, this clamp exhibits the disadvantages that it can only be used with a screwdriver, and not a screw gun, and that the screw is bearing the load of the board, and thus is subject to shearing or failure. Furthermore, there is no provision for ensuring that the screw goes into the joist in the exact direction, nor of predetermining the distance of travel of said screw. Finally, because it has to be screwed through the panel, the probability of damage thereto, is increased.

In U.S. Pat. No. 5,002,446 there is described a wallboard support tool, which comprises a tapered screw having a threaded section and a formed head section. A handle having a flat surface and an angled side surface contains the head section of the screw. Again, this tool is not adapted for installation using a screw gun but rather has to be used manually, Furthermore, the screw will form the load bearing member and thus be subject to breakage.

There exists, therefore, the need for an inexpensive method of temporarily suspending the ceiling drywall boards in position so that the permanent drywall screws can be inserted simply, less laboriously and more rapidly.

SUMMARY OF THE INVENTION

In accordance with the present invention there is provided a hook functional to temporarily support a drywall board prior to its permanent attachment to a ceiling joist.

More specifically, in its simplest embodiment, the hook comprises an integral Z-shaped body defining an upper and a lower outwardly extending, generally rectangular section, overlapping at their inner ends. As a result a generally central, thicker section is formed, A threaded fastener, for example a screw or the like, is screwed longitudinally through the central section at about the mid-point of the body.

In its preferred embodiment, the invention is a hook having first and second rectangular leg sections. These sections both define circular bores adjacent their inner ends. The leg sections overlap at the centre of the hook, with both inner bores being in coaxial alignment. A spool member is releasably inserted into said bores thereby securing said leg sections one to another. Rotation of the hook at its central axis in a plane perpendicular to the vertical axis of the spool thus can take place. Preferably, a portion of the upper surface of the lower leg section is cut-away to further prevent relative rotation of the leg sections one to another. A threaded fastener is positioned through the central bore of the spool. The fastener is provided with a stop, namely a collar, which encircles the fastener at about the inner end of the threaded portion thereof. The collar functions to prevent the fastener from falling out of the hook. Furthermore, a guide means is provided to ascertain that the fastener is inserted in a uniform direction of travel into the joist.

As a result of this arrangement, the following advantages arise. The drywall board may be installed by one man alone, much more quickly, simply and with far less exertion than any of the prior art devices. The Z-shaped configuration of the body provides for the body per se, and not the screw, bearing the load. This effectively eliminates any risk of mechanical failure, thus avoiding injury to the installer, and damage to the board. Finally, the assembly is adapted for use with a screw gun, thereby facilitating and accelerating installation.

Broadly stated the invention comprises a hook adapted for the temporary support of a drywall board being secured to ceiling joists, said hook comprising an integral body defining two stepped outwardly extending generally rectangular sections, having an interconnecting section therebetween, and a threaded fastener extending through said interconnecting section and therebeyond, thereby being adapted to releasably and rotatably secure said hook to said ceiling joist.

In a second broad aspect the invention is a hook adapted for the temporary support of a drywall board being secured to ceiling joists, said hook comprising first and second generally rectangular leg sections which overlap at their inner ends, means for securing said leg sections one to another, and a threaded fastener extending longitudinally through said overlapping section at substantially the mid-point thereof.

DESCRIPTION OF THE PREFERRED EMBODIMENT

Figure 1:
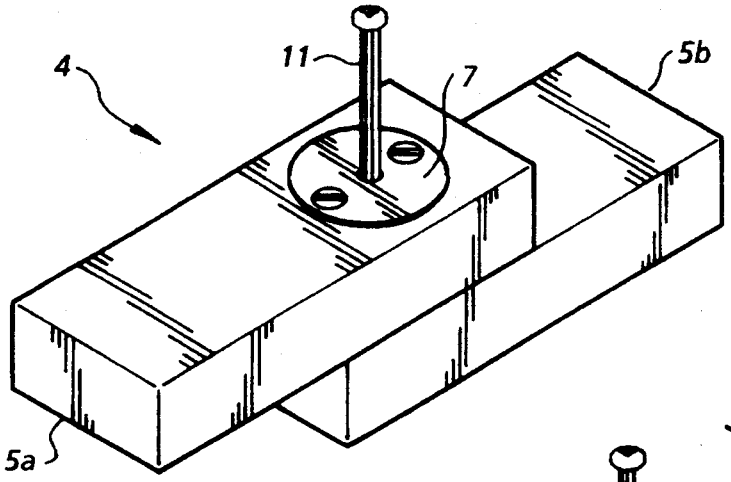
FIG. 1 is a perspective view of a second, preferred embodiment of a hook.
Figure 2:
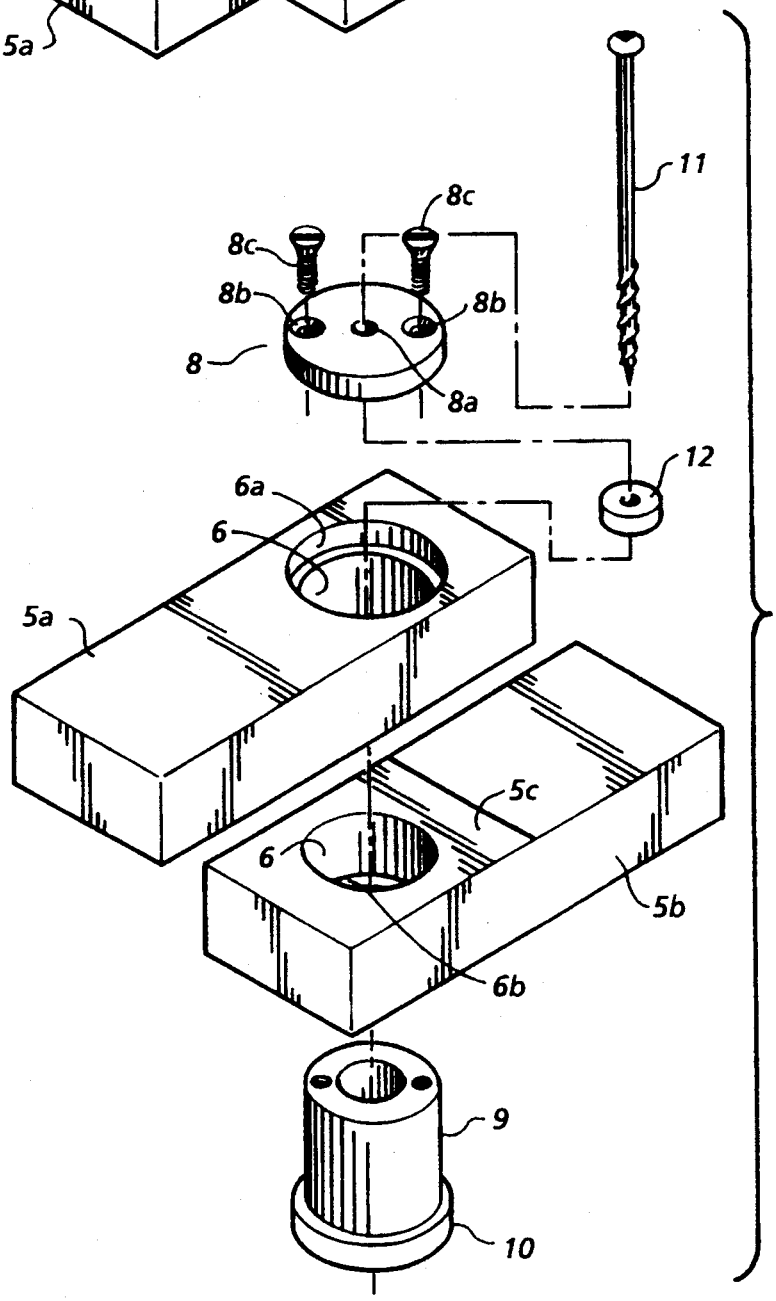
FIG. 2 is an exploded view of the hook of FIG. 1.
Figure 3:
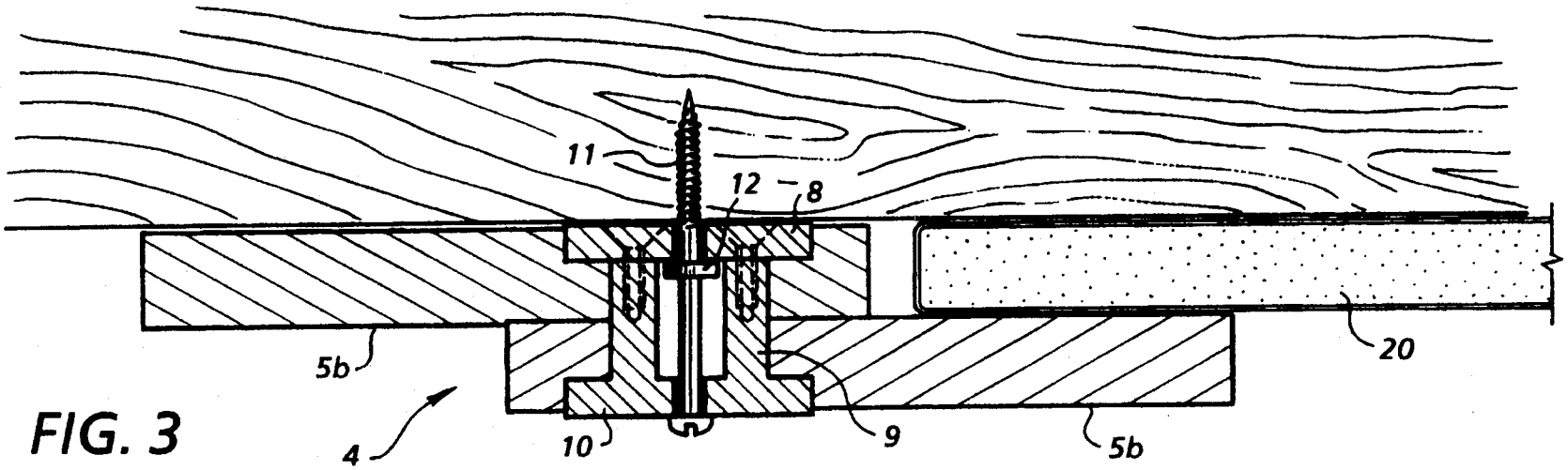
FIG. 3 is a side-sectional view of the hook of FIG. 1 as temporarily installed in a ceiling joist.
Figure 4:
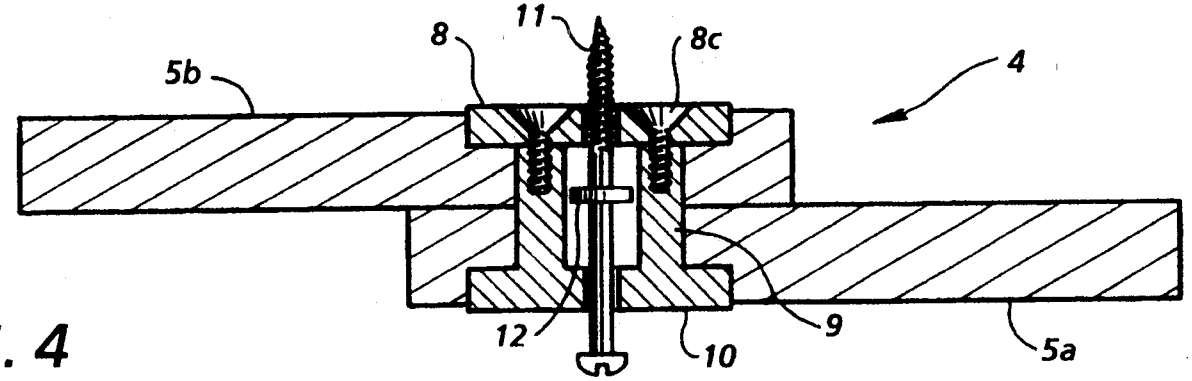
FIG. 4 is a side-sectional of the hook of FIG. 1.
Figure 5:
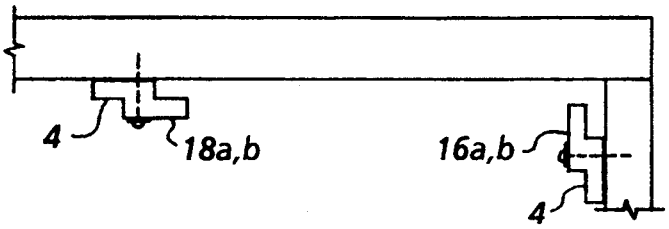
FIGS. 5–10 depict schematically the use of the hooks during the installation of drywall board.
Figure 6:
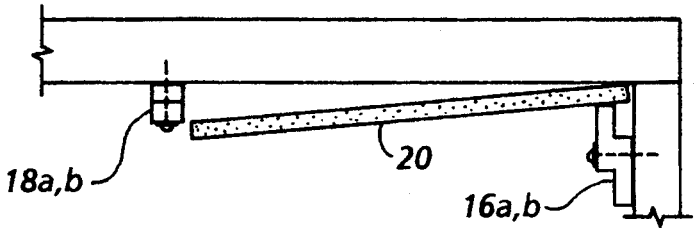
Figure 7:
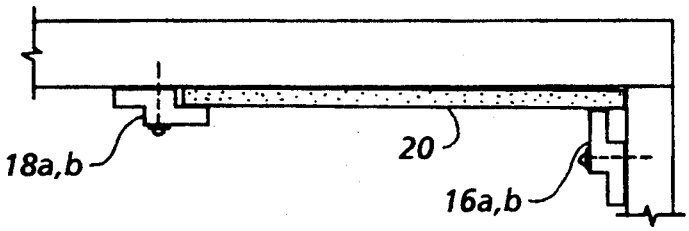
Figure 8:
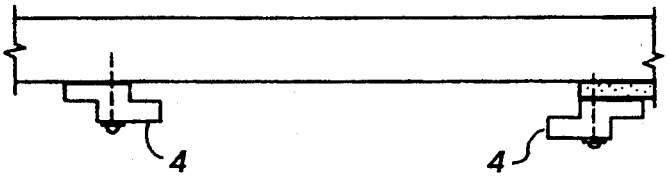
Figure 9:
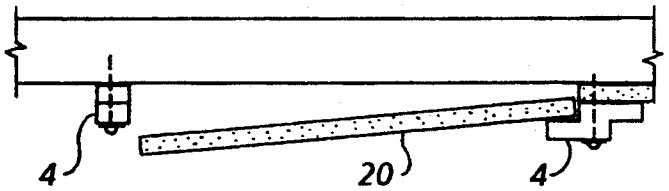
Figure 10:
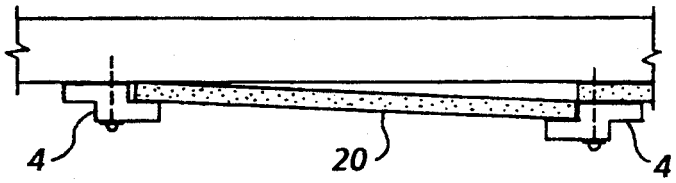
Figure 11:
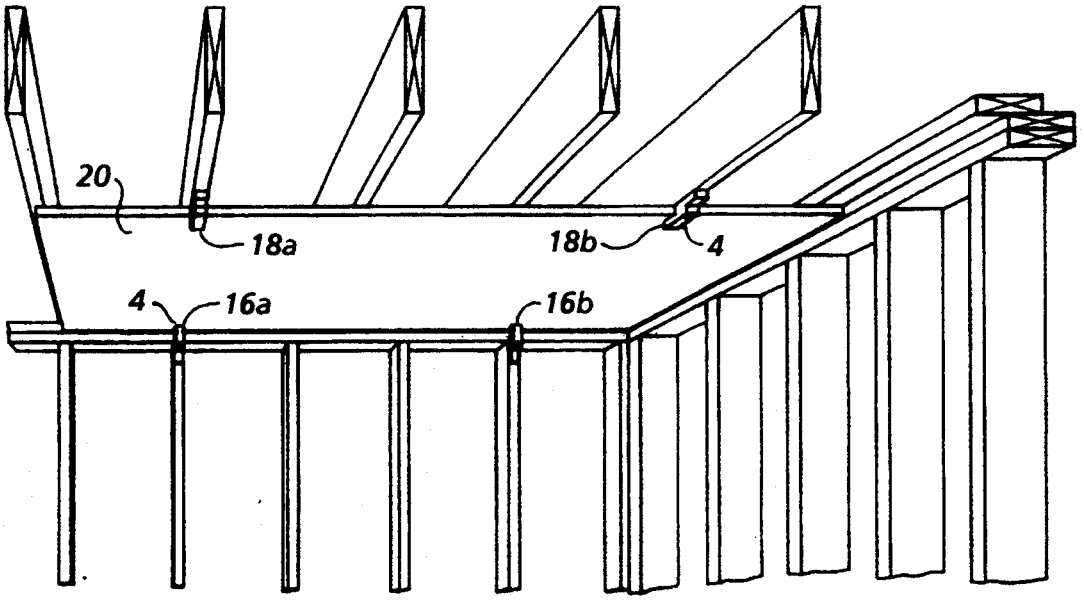
FIG. 11 is a perspective of the hook of FIG. 1 as utilized in the installation of the drywall boards in the ceiling.
Figure 12:
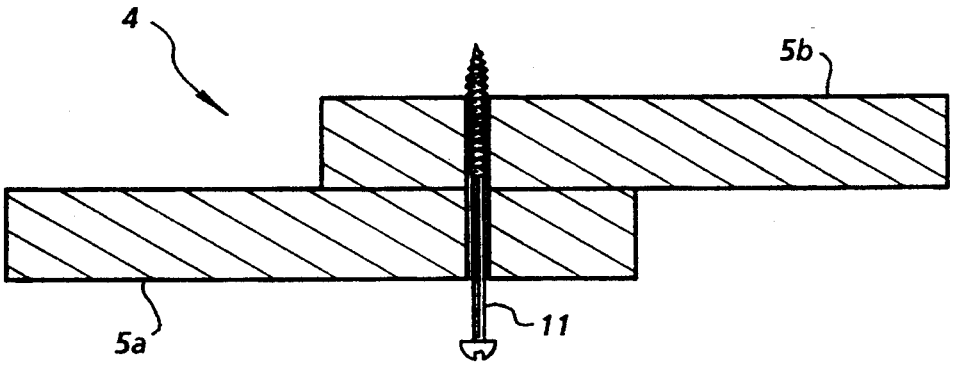
FIG. 12 illustrates the hook in its simplest embodiment.

Having reference to accompanying drawings, FIG. 12 is illustrative of a first embodiment of the invention.

More specifically, there is shown a hook 4 functional to temporarily support a drywall board prior to its installation as a ceiling unit. The hook 4 comprises an integral stepped body forming upper and lower generally rectangular leg sections 5*a* and 5*b* respectively. A screw 11 extends through the thicker, central section of the body 4 at its mid-point. The thicknesses of sections 5*a* and 5*b*, which may differ from one another, may be ¾" or ½" depending upon the thickness of the drywall board. The body 4 may be formed of a plastic material, exemplary of which would be polyvinyl chloride, wood, aluminium, a suitable metal or the like.

Turning now to the second, preferred, embodiment of the hook 4 illustrated in FIGS. 1–4 inclusive.

There is provided an upper, generally rectangular leg section and a lower, generally rectangular leg section 5*a* and 5*b* respectively. The length of both sections 5*a* and 5*b* would be equal, although their thicknesses may differ. A circular bore 6 is defined adjacent one end of each section 5*a* and 5*b*. A rectangular section 5*c* is cutaway from the top surface of section 5*b* so as to eliminate relative rotation between upper and lower sections during rotation of the hook 4. At the upper end of the bore 6 of upper section 5*a* there is defined a circular flange 6*a*. Similarly, at the lower end of lower section 5*b*, there is defined a circular flange 6*b*.

A spool 7 comprised of a circular plate 8 and a cylindrical barrel 9 having and annular end plate 10 integral therewith is provided. The plate 8 defines a central aperture 8*a* adapted to receive the screw 11. A second pair of diametric opposed apertures 8*b* are adapted to receive screws 8*c* which secure plate 8 to barrel 9. End plates 8 and 10 are supported by bore flanges 6*a* and 6*b*. Thus when screws 8*c* are tightened the spool 7 becomes a unitary member securing legs 5*a* and 5*b* one to another. It will be noted too, that end plates 8 and 10 project outwardly a small distance from the outer surfaces of legs 5*a* and 5*b* so as to facilitate rotation of the hook 4. The screw 11 bears a stop member comprising a circular collar 12 which is secured to the screw 11 at the upper end of the threaded section thereof. The screw 11 is passed into the circular bore of the spool 7. Thus leg sections 5*a* and 5*b* are releasably secured one to another, and screw 11 is free to rotate within the spool 7 until collar 12 reaches plate 10. It will be noted that a narrower bore is formed in plate 10 and serves as a guide member to ensure that the screw 11 goes into the joist in a uniform direction.

In operation, as illustrated in FIGS. 5–10, first and second hooks 16*a* and 16*b* are installed vertically, spaced-apart on the wall with the top of the hook 16 being ¾" from the ceiling top.

A second pair of hooks 18*a* and 18*b* are positioned the requisite distance from the wall and rotated 90° relative to the angularity of said first hooks 16. The drywall board 20 is then mounted on the first hooks 16 and raised. The second hooks 18 are then rotated by 90° to thereby support the board 20 and permit the permanent drywall screws to be installed. The temporary hooks 16 may then be removed from the wall, installed at the desired distance from hooks 18 and the procedure repeated until the ceiling is complete.

The embodiments of the invention in which an exclusive property or privilege are claimed are defined as follows:

1. A hook adapted for the temporary support of a drywall board being secured to ceiling joists, said hook comprising an integral, z-shaped body defining two outwardly extending, generally rectangular sections, having an overlapping central section therebetween, and a threaded fastener extending through said overlapping section and therebeyond, thereby being adapted to releasably and rotatably secure said hook to said ceiling joist.

2. The hook as set forth in claim 1 further comprising a spool member positioned longitudinally within said overlapping section and wherein said fastener is mounted within said spool, whereby said spool member permits of rotation of said hook.

3. The hook as set forth in claim 2 further comprising fastener guide means associated with said spool, to ensure that said fastener enters said joist in a uniform direction.

4. A hook for temporarily supporting a drywall board prior to its permanent securement to a ceiling joist which comprises first and second generally rectangular leg sections, said sections each defining circular bores adjacent their inner ends, said sections being overlapped at their inner ends whereby said bores are in coaxial alignment;

a spool member inserted within said bores, which spool member is functional to secure said leg sections one to another and to rotate said hook;

a threaded fastener extending through said bore of said spool member;

a collar mounted on said threaded fastener; and guide means associated with said spool member for ensuring a uniform direction of travel of the fastener.

* * * * *